US008155354B2

(12) United States Patent
Ehrlund

(10) Patent No.: US 8,155,354 B2
(45) Date of Patent: Apr. 10, 2012

(54) ELECTRO ACOUSTIC TRANSDUCER

(76) Inventor: Göran Ehrlund, Stora Skedvi (SE)

( * ) Notice: Subject to any disclaimer, the term of this patent is extended or adjusted under 35 U.S.C. 154(b) by 1031 days.

(21) Appl. No.: 11/994,051

(22) PCT Filed: Jun. 30, 2006

(86) PCT No.: PCT/SE2006/050235

§ 371 (c)(1),
(2), (4) Date: Mar. 31, 2008

(87) PCT Pub. No.: WO2007/004981

PCT Pub. Date: Jan. 11, 2007

(65) Prior Publication Data

US 2008/0205673 A1 Aug. 28, 2008

(30) Foreign Application Priority Data

Jul. 1, 2005 (SE) ..... 0501528

(51) Int. Cl.
*H04R 25/00* (2006.01)

(52) U.S. Cl. ..... 381/174; 660/345; 660/365

(58) Field of Classification Search ..... 381/174; 600/345, 365
See application file for complete search history.

(56) References Cited

U.S. PATENT DOCUMENTS

| | | | | |
|---|---|---|---|---|
| 3,814,864 | A | 6/1974 | Victoreen | |
| 4,776,019 | A | 10/1988 | Miyatake | |
| 4,864,234 | A * | 9/1989 | Brooks | 324/228 |
| 2005/0027463 | A1 | 2/2005 | Goode, Jr. et al. | |
| 2005/0089180 | A1 * | 4/2005 | Saeki et al. | 381/174 |
| 2007/0173710 | A1 * | 7/2007 | Petisce et al. | 600/345 |
| 2009/0103763 | A1 * | 4/2009 | Petef et al. | 381/380 |

FOREIGN PATENT DOCUMENTS

EP 1 513 370 A2 3/2005

* cited by examiner

*Primary Examiner* — Phuc Dang
(74) *Attorney, Agent, or Firm* — Foley & Lardner LLP

(57) ABSTRACT

A condenser microphone capsule is described. The condenser microphone capsule (10) has an electrically conducting transducer membrane (15) arranged in parallel with and at a distance from an electrically conducting electrode surface (26) wherein the active area (20) of the transducer membrane has an essentially triangular shape. The microphone capsule may comprise a lid (50) with a membrane opening (55) that defines the shape of the active area (20) of the transducer membrane (15).

14 Claims, 7 Drawing Sheets

ELECTRO ACOUSTIC TRANSDUCER

CROSS-REFERENCE TO RELATED APPLICATIONS

This application is a national stage of International Application PCT/SE2006/050235, filed Jun. 30, 2006, and claiming foreign priority to Swedish Application No. 0501528-4, filed on Jul. 1, 2005, each of which are fully incorporated herein by reference.

FIELD OF THE INVENTION

The present invention relates to an electro acoustic transducer and more in particular a condenser microphone for transformation of sound waves to an electric signal.

BACKGROUND

Condenser microphones are known since early $20^{th}$ century and have essentially not changed since then. The condenser microphones consist essentially of a back plate, which is one plate of a condenser and a transducer membrane which is spaced closely to the back plate that is the other plate of the condenser. A polarizing voltage is applied between the two plates, and the capacitance change provides the output from the device.

Throughout the prior art, the transducer membranes used are predominantly of circular shape. One example of a condenser microphone with a non circular membrane is shown in U.S. Pat. No. 3,814,864 wherein the diaphragm is broken up into many small pieces so that each attains a natural high frequency resonance above the range of sounds to be picked up with the sum total of the pieces providing an output as great as a single diaphragm with a lower impedance. This is achieved by providing a series of concentric ring contacts with a diaphragm stretched over the rings, the highest points or ridges of which lie on a convex surface, to break up the diaphragm into annular sections.

However known condenser microphones and microphone capsules suffer from more or less pronounced resonance phenomena which deteriorate the sound quality.

SUMMARY OF THE INVENTION

The present invention aims to solve the problems with non-linear frequency response for condenser microphones. According to the invention the basic object with the invention is achieved by the invention as defined in the independent claims.

One advantage with such a microphone is that the sound reproduction is improved, as strong local frequency variations do not occur, whereby a smoother frequency response is achieved.

Advantageous embodiments of the invention are defined in the dependent claim.

DETAILED DESCRIPTION OF THE INVENTION

Figure 3A:
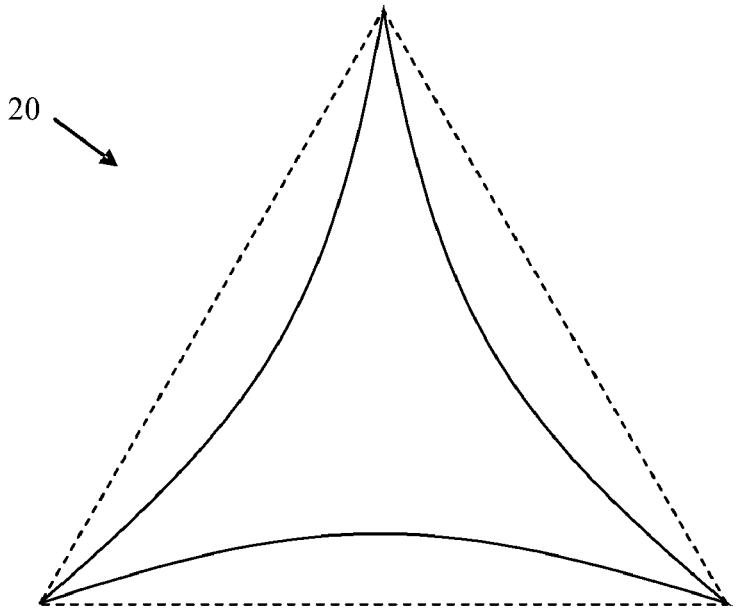
FIGS. 3*a* and 3*b* schematically show alternative shapes of the active membrane area according to the present invention.
Figure 3B:
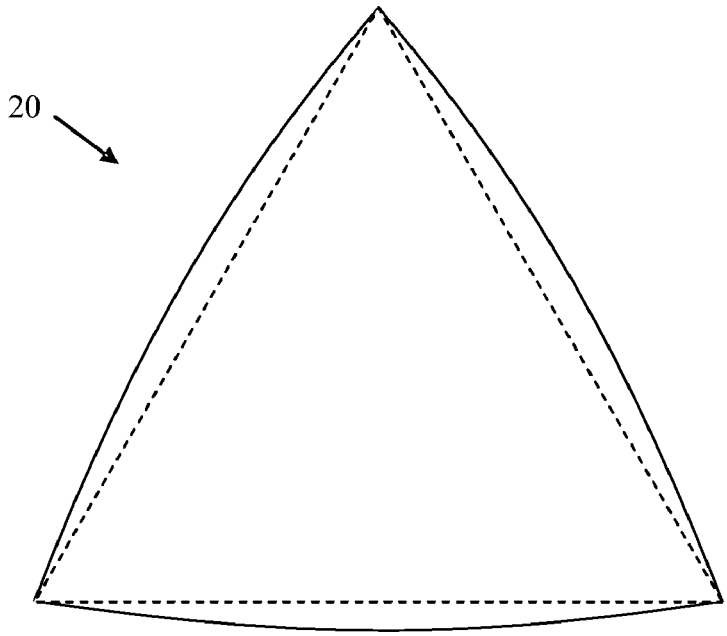

In this specification, the expression essentially triangular shape comprises all types of triangles, even if the disclosed embodiment is an equilateral triangle. Moreover, the expression comprises shapes of the types shown in FIGS. 3*a* and 3*b*, where 3*a* shows a triangular shape with concave curved sides and FIG. 3*b* a triangular shape with convex curved sides. Other possible embodiments comprise triangles with rounded or alternatively cut corners, recesses from one or more of the sides and possible combinations of these.

Figure 1A:
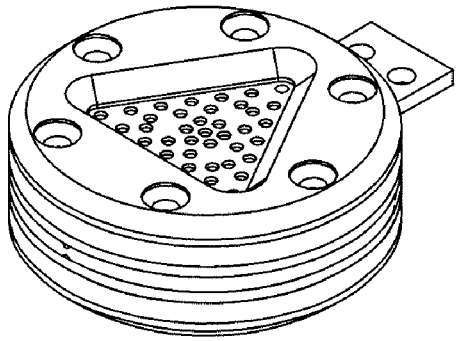
FIG. 1*a* shows a perspective view of one embodiment of a microphone capsule according to one embodiment of the present invention, with the membrane removed.
Figure 1B:
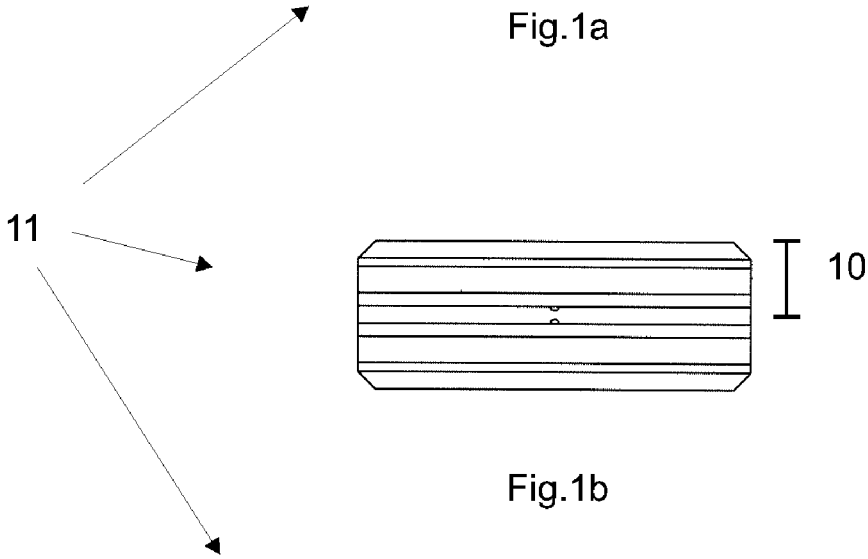
FIG. 1*b* shows a side view of a microphone capsule according to FIG. 1*a*.
Figure 1C:
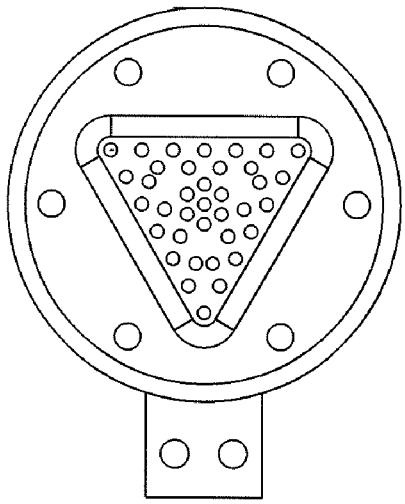
FIG. 1*c* shows a top view of a microphone capsule according to FIG. 1*a*.
Figure 2:
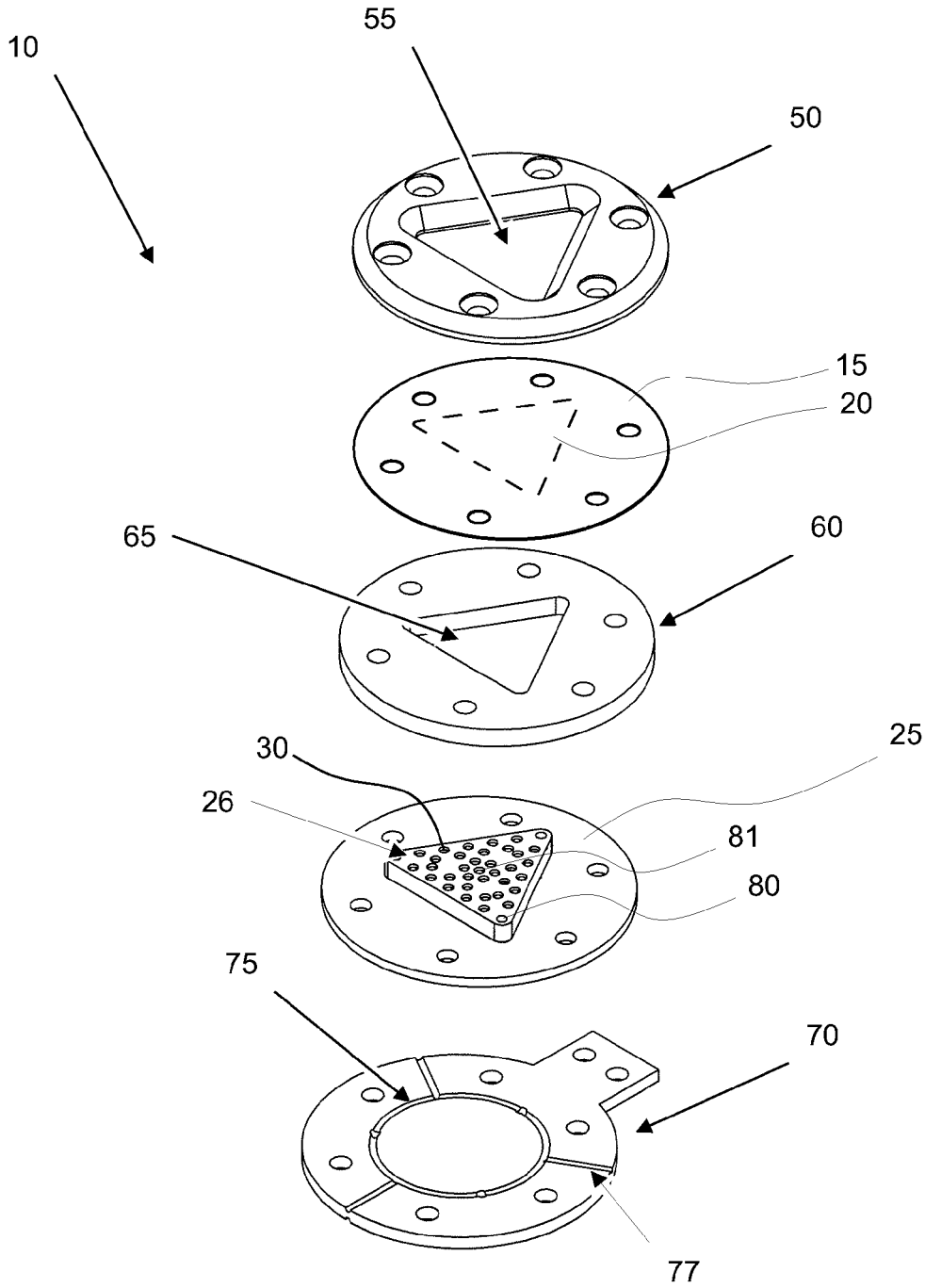
FIG. 2 shows an exploded view of one half of the microphone capsule according to FIG. 1.

FIGS. 1*a* to 1*c* show one embodiment of a dual microphone capsule 11 according to the pre-sent invention in different views. In FIGS. 1*a-c* the transducer membrane is removed. FIG. 2 shows an exploded view of a single condenser microphone capsule 10 according to FIG. 1. The condenser microphone capsule 10 comprises a lid 50 with a membrane opening 55 that defines the shape of the active area 20 of the transducer membrane, an electrically insulating frame 60 with a corresponding membrane opening 65, a membrane 15 clamped between the lid and the frame, a back piece 25 with an electrically conducting electrode surface 26, and a mounting plate 70. As is shown in FIG. 2, the active area 20 of the transducer membrane 15 is of an essentially triangular shape, which has been found to give a remarkably improved sound reproduction.

The electrode surface 26 of the back piece 25 has a shape that corresponds to the shape of the active membrane area 20. In the disclosed embodiment, the electrode surface 26 is formed as the top surface of a raised section of the back piece 25, the height of which is closely related to the thickness and form of the insulating frame 60, as they together define the distance between the bottom surface of the membrane and the electrode surface 26, hereafter referred to as condenser gap. The insulating frame 60 and the raised portion of the back piece with the electrode surface 26 together ensures that the transducer membrane 15 is arranged in parallel with and at the desired condenser gap from the electrically conducting electrode surface 26. As in all condenser microphones, the precision of the condenser gap is very important. According to one embodiment, the condenser gap is less than 0.1 mm and preferably less than 0.05 mm.

According to the disclosed embodiment, the electrode surface 26 of the back piece 25 is provided with a plurality of attenuation recesses 30 arranged in a pattern with respect to the active area 20 of the transducer membrane 15. The attenuation recesses 30 are provided to reduce the effect of transverse flow of air in the condenser gap, and to provide controlled attenuation of the membrane 15. One embodiment of the attenuation recess pattern is discussed in more detail below, with reference to FIGS. 4*a* and 4*b*. According to one embodiment, the attenuation recesses 30 are bore holes of a pre-defined diameter and depth in the back piece 25. The attenuation recesses 30 may be of equal diameter and depth, or the diameter and/or depths can be individually adapted to provide desired characteristics of the registered sound.

The dual capsule 11 according to FIG. 1 comprises two condenser microphone capsules 10 constructed according to above, each arranged with a bottom surface of its respective back piece 25 against an insulating mounting plate 70. In order to provide pressure equalizing in the condenser gap, the mounting plate 70 comprises, on each of its sides, a pressure equalization groove 75 that is formed so that it is in fluidic contact with the cavity between each membrane and its corresponding back piece, via one or more vent holes 80 extending from the electrode surface 26 through to the bottom side of the back piece 25. In the assembled state the vent holes 80 are aligned with the pressure equalization groove 75 in the mounting plate 70. The pressure equalization groove 75 in the mounting plate 70 has vent grooves 77 that are in communication with the ambient pressure. According to one embodiment, the attenuation holes situated at the corners of the triangular active membrane area 20 through holes are formed as vent holes 80.

Figure 5:
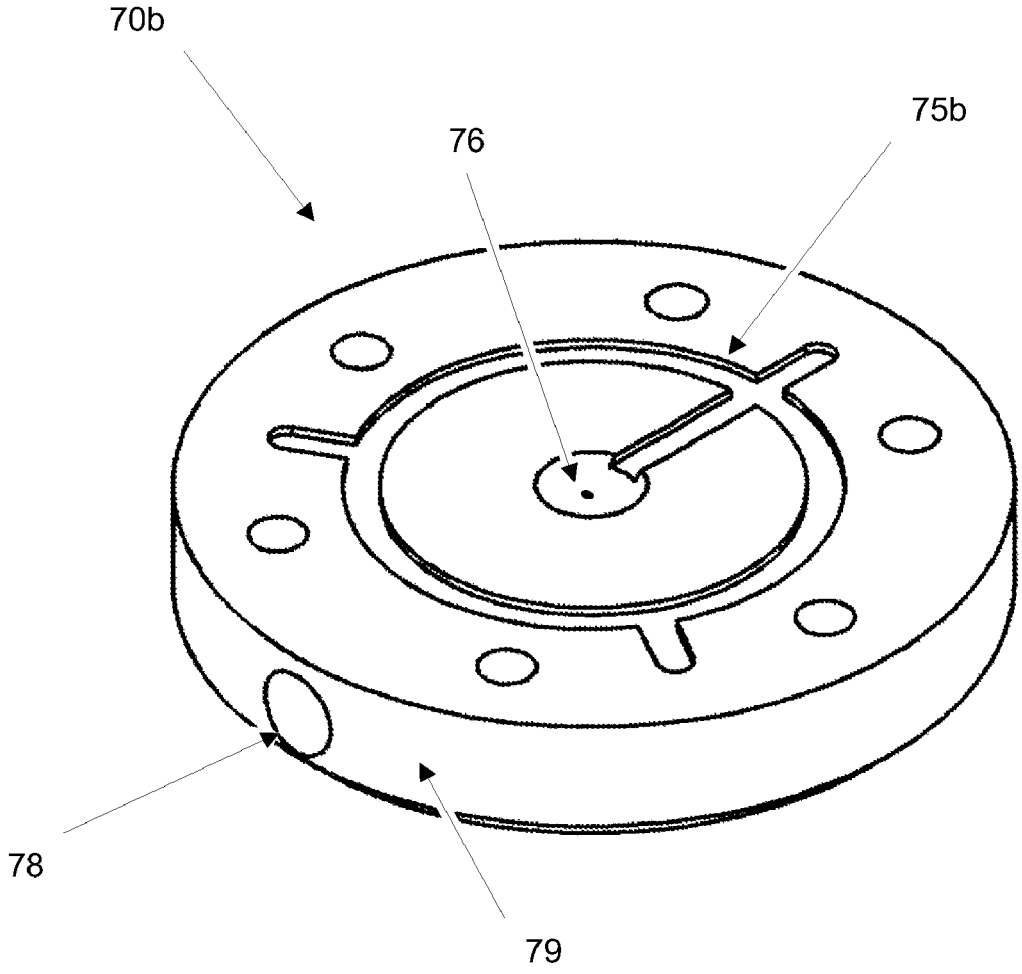
FIG. 5 shows an alternative mounting plate according to the present invention.
Figure 6:
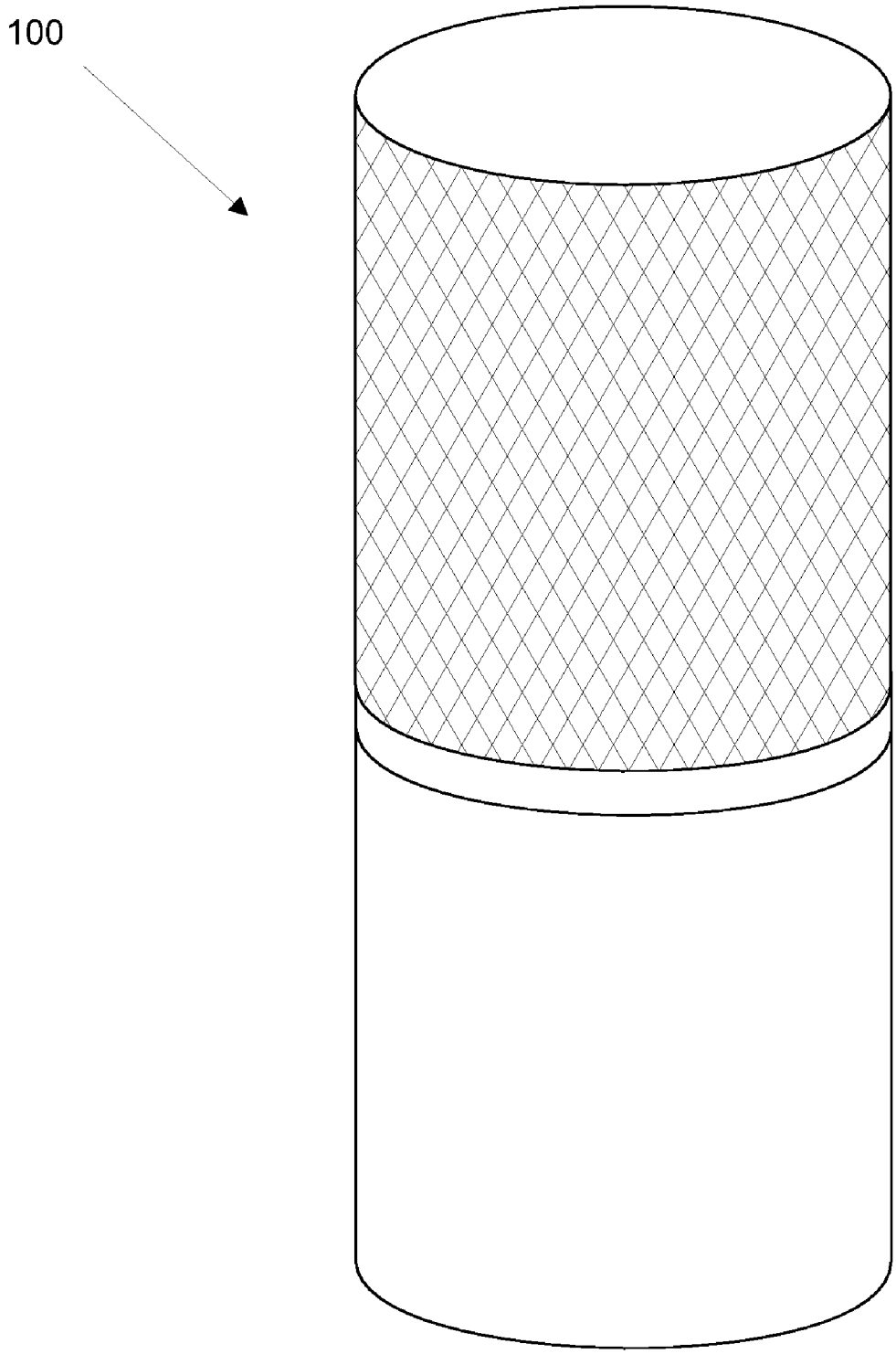
FIG. 6 shows a microphone according to the present invention.

FIG. 5 shows another embodiment of a mounting plate 70*b* according to the present invention. The mounting plate 70*b* is, on each side, provided with a pressure equalization groove 75*b* that is formed to provide fluidic contact between vent holes 80 and a central vent hole 81 in the back piece 25. The mounting plate 70*b* is provided with at least one radial mounting hole 78 that extends radially inward from the rim 79 of the mounting plate 70*b* and ends close to its center. The mounting hole 78 is used to fasten the dual capsule 11 in a microphone housing or the like, by use of e.g. a mounting screw (not shown). In one embodiment, the mounting plate comprises two diametrically arranged mounting holes 78, which enables mounting of two or more dual capsules 11 on top of each other by means of an interconnection screw (not shown). Further, the mounting plate 70*b* comprises a small sized vent hole 76 that interconnects the pressure equalization groove 75*b* at the center of the mounting plate with one of the mounting holes 78. In order to provide fluidic communication from the vent hole 76 to the ambient pressure, a specially designed vent screw may be used for fastening the capsule 11. Alternatively, the vent hole may be connected to the ambient pressure via a radial vent conduit (not shown) that extends from the rim 79 to the center of the mounting plate 70*b*.

According to one embodiment, each microphone capsule 10 is clamped together by screws (not shown) or the like that interconnect the lid 50 of the capsule 10 and the mounting plate 70, 70*b* so that all other components are clamped there between. In order to avoid a short circuit of the condenser, the screws are insulated from the back piece in that the screw holes in the back piece are of a large diameter compared to the screws, or by other insulating means. Alternatively, components of the microphone capsules 10 can be secured in any other suitable fashion known in the art. According to one embodiment, the lid 50 is omitted and the transducer membrane 15 is fastened directly to the upper surface of the insulating frame 60.

The lid 50 is made of a rigid material, that according to one embodiment is electrically conducting and in electric contact with the conducting membrane, but it may also be an insulated from the membrane. The back piece 25 is made of an electrically conducting material such as a metallic material like brass etc. Alternatively, the back piece 25 can be made of a rigid insulating material, with a conducting layer forming the electrode surface 26. According to one embodiment, the mounting plate 70, 70*b* and the insulating frame 60 are made of a rigid polymer material such as polyoxymethylene (POM) or the like. The transducer membrane 15 is made of a thin foil of a conducting material or of a thin insulating film with a conducting layer applied thereon, or the like. By this arrangement the two microphone capsules 10 of the dual capsule 11 are electrically separated from each other.

As already mentioned, the active area 20 of the transducer membrane 15 has an essentially triangular shape as defined above. According to one embodiment the active area 20 has the shape of an equilateral triangle. According to one embodiment the active area 20 has the shape of a triangle with one or more curved sides.

Figure 4A:
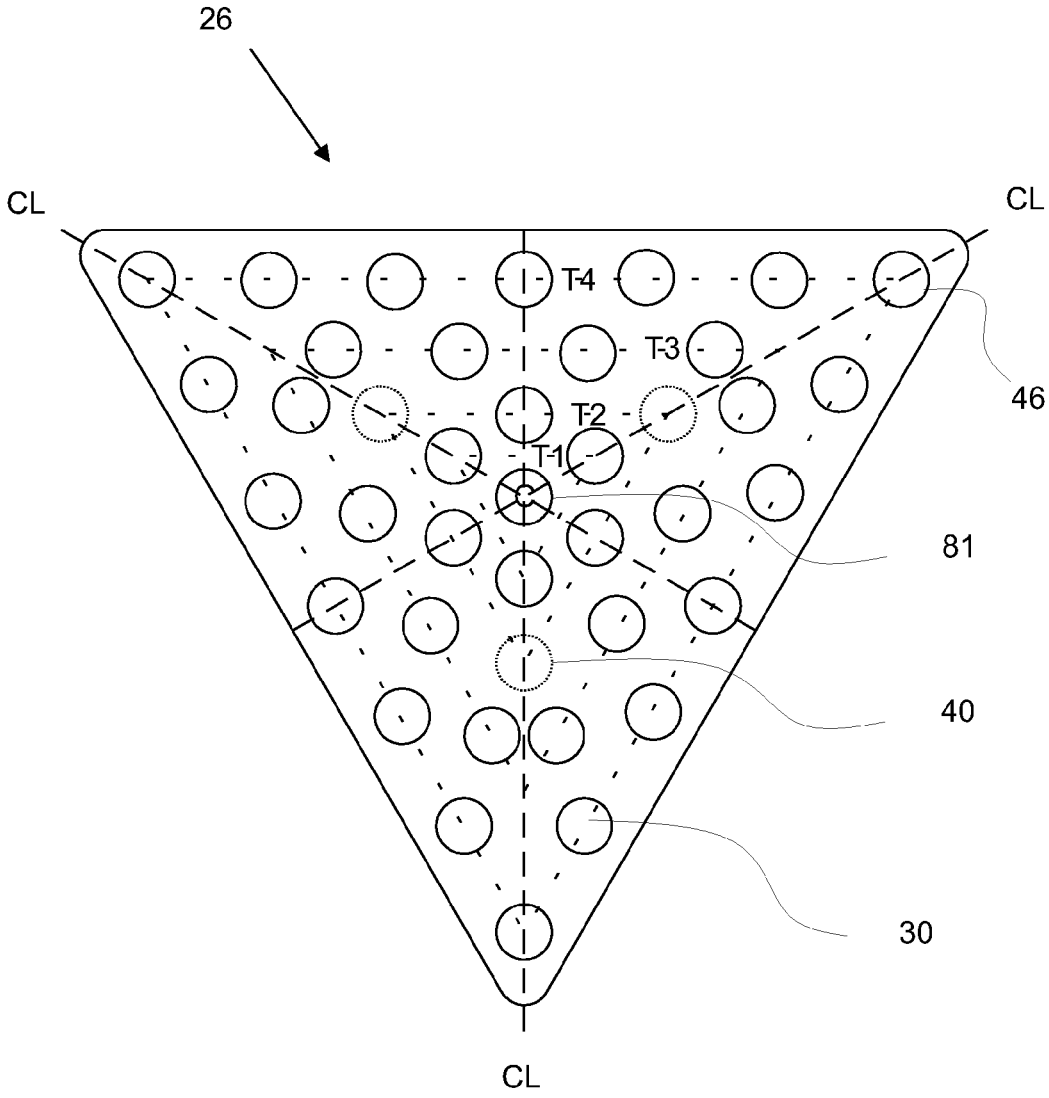
FIGS. 4*a* and 4*b* shows the locations of attenuation recesses in the bottom plate according to one embodiment.
Figure 4B:
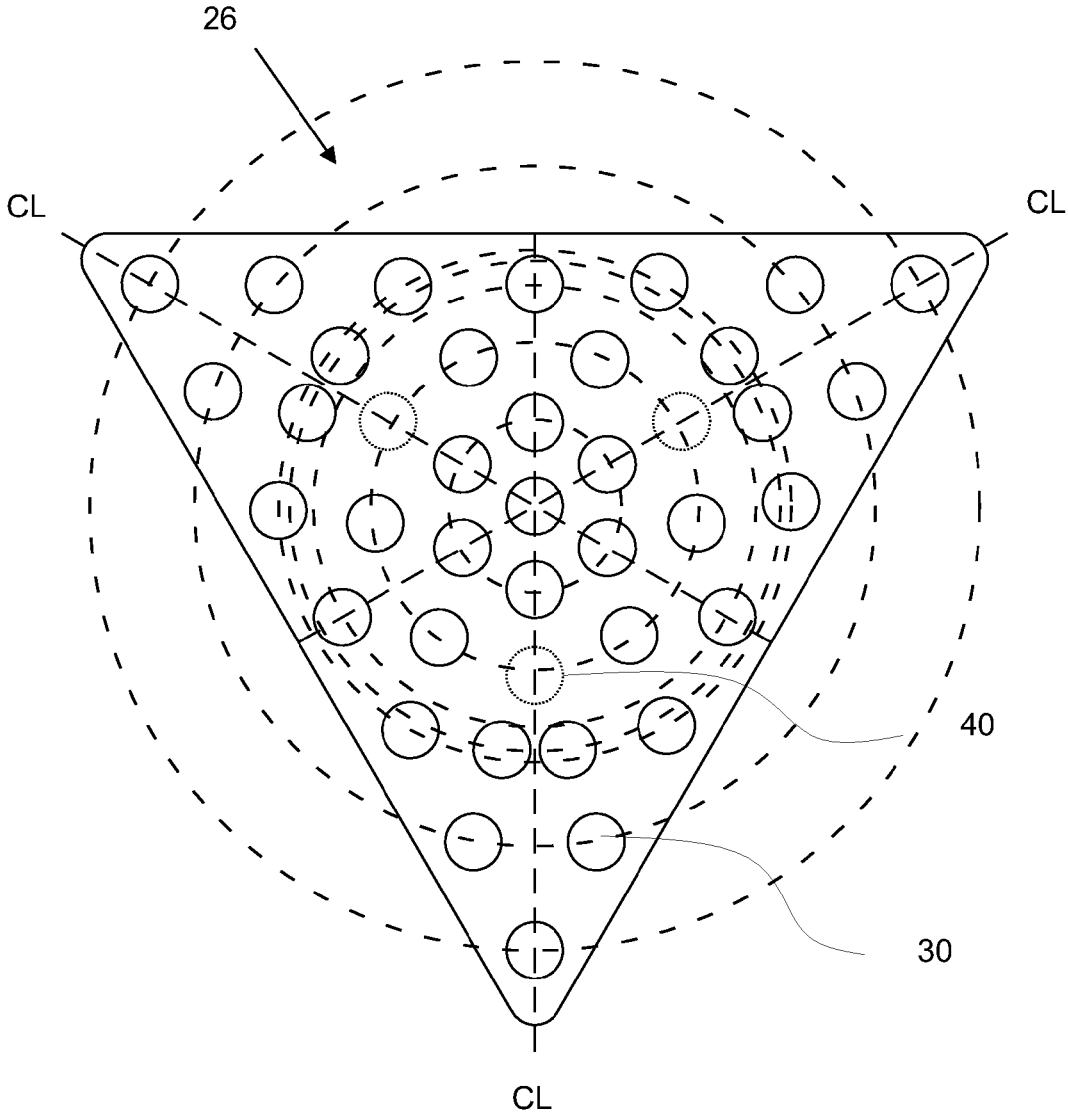

According to one embodiment schematically shown in FIG. 4*a*, the active area 20 is shaped like an equilateral triangle and the attenuation recesses 30 in the electrode surface 26 of the back piece 25 are arranged in a threefold rotational symmetric pattern with an axis of rotation coaxial with the centre C of the triangle. FIG. 4*b* is an alternative presentation that more clearly shows the rotational symmetry of the attenuation recesses 30 according to FIG. 4*a*. According to one embodiment the attenuation recesses 30 are arranged in a mirror symmetrical pattern with respect to the centre lines CL of the triangle. According to one embodiment, one attenuation recess 30 is arranged concentric with the centre of the triangle. According to one embodiment, the attenuation recesses 30 are arranged along the sides of a number of concentric triangles of increasing sizes T1 to T4.

By this configuration of the shape of the active area of the transducer membrane and the attenuation recesses, a well balanced registration of sound waves is achieved without marked resonance phenomena.

According to one embodiment, the electrode surface 26 of the back piece 25 comprises three tuning recesses 40 arranged at the corners of one of the concentric triangles T1 to T4, wherein the shape and depth of the tuning recesses 40 are adjusted to achieve desired sound characteristics. In the disclosed embodiment, the tuning recesses are arranged at the corners of a concentric triangle T2, the side of which is less then ½ and more than ¼ of the side of the active area.

In the disclosed embodiment, all attenuation recesses are shown as circular holes with the same diameter, but it is also possible to have attenuation recesses of different diameters or shapes. Moreover, the performance of the microphone capsule 10 may be tuned both by adjusting the depth of the attenuation holes, in particular the tuning recesses.

The condenser microphone capsule 10 according to the present invention can be used in a condenser microphone or in other applications where high quality registration of sound waves is required. FIG. 5 shows an example of a condenser microphone 100 comprising a dual microphone capsule 11 according to the present invention.

The invention claimed is:

1. Condenser microphone capsule with an electrically conducting transducer membrane arranged in parallel with and at a distance from an electrically conducting electrode surface wherein an active area of the transducer membrane has an essentially triangular shape, wherein the microphone capsule comprises a lid with a membrane opening that defines the shape of the active area of the transducer membrane, an electrically insulating frame with a corresponding membrane opening, a back piece comprising the electrically conducting electrode surface, and wherein the membrane is clamped between the lid and the frame.

2. Condenser microphone capsule according to claim 1, wherein the active area has the shape of an equilateral triangle.

3. Condenser microphone capsule according to claim 1, wherein the active area has the shape of a triangle with one or more curved sides.

4. Condenser microphone capsule according to claim 1, wherein the electrode surface comprises a plurality of attenuation recesses arranged in a pattern below the active area of the transducer membrane.

5. Condenser microphone capsule according to claim 4, wherein the active area is shaped like an equilateral triangle and the attenuation recesses are arranged in a threefold rotational symmetric pattern with an axis of rotation coaxial with the centre of the triangle.

6. Condenser microphone capsule according to claim 4, wherein the attenuation recesses are arranged in a mirror symmetrical pattern with respect to the centre lines of the triangle.

7. Condenser microphone capsule according to claim 4, wherein one attenuation recess is arranged concentric with the centre of the triangle.

8. Condenser microphone capsule according to claim 4, wherein the attenuation recesses are arranged along the sides of a number of concentric triangles of increasing sizes.

9. Condenser microphone capsule according to claim 8, wherein the electrode surface comprises three tuning recesses arranged at the corners of one of the concentric triangles, wherein the shape and depth of the tuning recesses are adjusted to achieve desired sound characteristics.

10. Condenser microphone capsule according to claim 9, wherein the tuning recesses are arranged at the corners of a concentric triangle, the side of which is less than ½ and more than ¼ of the side of the active area.

11. Condenser microphone capsule according to claim 1, further comprising a mounting plate.

12. Dual condenser microphone capsule comprising two condenser microphone capsules according to claim 1 arranged with a bottom surface of the back piece against a mounting plate.

13. Condenser microphone capsule according to claim 11, wherein the mounting plate comprises a pressure equalization groove formed to be in fluidic contact with a cavity between the membrane and its corresponding back piece, via vent holes in the back piece.

14. Condenser microphone comprising a condenser microphone capsule according to claim 1.

* * * * *